US010105831B2

(12) United States Patent
Sun

(10) Patent No.: US 10,105,831 B2
(45) Date of Patent: Oct. 23, 2018

(54) RATCHET TOOL

(71) Applicant: SHANGHAI EASY-USE TOOLS ENTERPRISE CO. LTD., Shanghai (CN)

(72) Inventor: Shiyu Sun, Shanghai (CN)

(73) Assignee: SHANGHAI EASY-USE TOOLS ENTERPRISE CO. LTD, Shanghai (CN)

( * ) Notice: Subject to any disclaimer, the term of this patent is extended or adjusted under 35 U.S.C. 154(b) by 0 days.

(21) Appl. No.: 15/026,053

(22) PCT Filed: May 14, 2014

(86) PCT No.: PCT/CN2014/077438
§ 371 (c)(1),
(2) Date: Mar. 30, 2016

(87) PCT Pub. No.: WO2015/149421
PCT Pub. Date: Oct. 8, 2015

(65) Prior Publication Data

US 2016/0279780 A1 Sep. 29, 2016

(30) Foreign Application Priority Data

Apr. 4, 2014 (CN) ..... 2014 2 01639145 U

(51) Int. Cl.

| | |
|---|---|
| ***B25B 13/46*** | (2006.01) |
| ***B25F 1/02*** | (2006.01) |
| ***B25G 1/10*** | (2006.01) |
| ***B25B 13/56*** | (2006.01) |
| ***B25F 1/04*** | (2006.01) |

(52) U.S. Cl.
CPC ..... *B25F 1/02* (2013.01); *B25B 13/463* (2013.01); *B25B 13/465* (2013.01); *B25B 13/56* (2013.01); *B25F 1/04* (2013.01); *B25G 1/105* (2013.01)

(58) Field of Classification Search
USPC ..... 81/58, 60, 61, 63
See application file for complete search history.

(56) References Cited

U.S. PATENT DOCUMENTS 1,614,039 A * 1/1927 Mandl ..... B25B 13/463 81/60
5,005,448 A * 4/1991 Main ..... B25B 13/00 81/177.1

(Continued)

FOREIGN PATENT DOCUMENTS

CN 2792715 7/2006
CN 101596707 12/2009

(Continued)

*Primary Examiner* — Joseph J Hail
*Assistant Examiner* — Shantese McDonald
(74) *Attorney, Agent, or Firm* — Muncy, Geissler, Olds & Lowe, P.C.

(57) ABSTRACT

A ratchet tool includes a cylindrical ratchet handle. The ratchet handle has an accommodation cavity therein. A multi-tool assembly is provided in the accommodation cavity and rotatable relative to the accommodation cavity. The present invention has a simple structure and is convenient for use. Multiple tools are provided to become one-piece. The entire contour is cylindrical, which is convenient for the user to hold the ratchet tool.

2 Claims, 3 Drawing Sheets

(56) References Cited

U.S. PATENT DOCUMENTS

| | | | | |
|---|---|---|---|---|
| 6,079,298 | A * | 6/2000 | Gasperi | B25B 15/04 81/177.1 |
| 6,976,408 | B2 * | 12/2005 | Chen | B25B 13/463 81/58 |
| 7,536,934 | B1 * | 5/2009 | Tatangelo | B25B 13/463 81/57.22 |
| 7,966,912 | B1 * | 6/2011 | Hobden | B25B 13/465 81/124.5 |
| 8,857,296 | B2 * | 10/2014 | Huang | B25B 13/463 81/60 |

FOREIGN PATENT DOCUMENTS

| | | |
|---|---|---|
| CN | 102310383 | 1/2012 |
| JP | 3147448 U | 12/2008 |

* cited by examiner

RATCHET TOOL

BACKGROUND OF THE INVENTION

1. Field of the Invention

The present invention relates to a ratchet tool, and more particularly to a multi-tool handle having a ratchet.

2. Description of the Prior Art

A conventional ratchet handle comprises a ratchet connected to a handle. During use, the user may need various tools. Therefore, the ratchet handle having a single tool is inconvenient for use and cannot meet the demand of different occasions except the user has purchased all kinds of tools. However, some tools may become idle after used once. This causes a waste. Because the tools are separate, they are inconvenient for storage and may be lost easily.

Accordingly, the inventor of the present invention has devoted himself based on his many years of practical experiences to solve these problems.

SUMMARY OF THE INVENTION

The primary object of the present invention is to provide a ratchet tool to solve the aforesaid shortcomings of the prior art.

In order to achieve the aforesaid object, the ratchet tool of the present invention comprises a ratchet handle. The ratchet handle has an accommodation cavity therein. A multi-tool assembly is provided in the accommodation cavity and rotatable relative to the accommodation cavity.

Preferably, the ratchet handle is a cylindrical ratchet handle.

Preferably, the cylindrical ratchet handle comprises a first outer casing and a second outer casing. The interior of the first outer casing is provided with ratchet teeth. The second outer casing is disposed inside the first outer casing. The second outer casing and the first outer casing engage with each other.

Preferably, the outer surface of the second outer casing is formed with an accommodation groove. The accommodation groove is provided with a detent therein. A spring is provided between the detent and the accommodation groove.

Preferably, the detent can be fully retracted into the accommodation groove by applying an external force.

Preferably, the multi-tool assembly comprises a fixing axle. Two ends of the fixing axle are connected to the second outer casing. The outer side of the fixing axle is provided with a sleeve. The outer side of the sleeve is provided with the plurality of tools.

The present invention has a simple structure and is convenient for use. Multiple tools are provided to become one-piece. The entire contour is cylindrical, which is convenient for the user to hold the ratchet tool.

DETAILED DESCRIPTION OF THE PREFERRED EMBODIMENTS

Embodiments of the present invention will now be described, by way of example only, with reference to the accompanying drawings.

Figure 1:
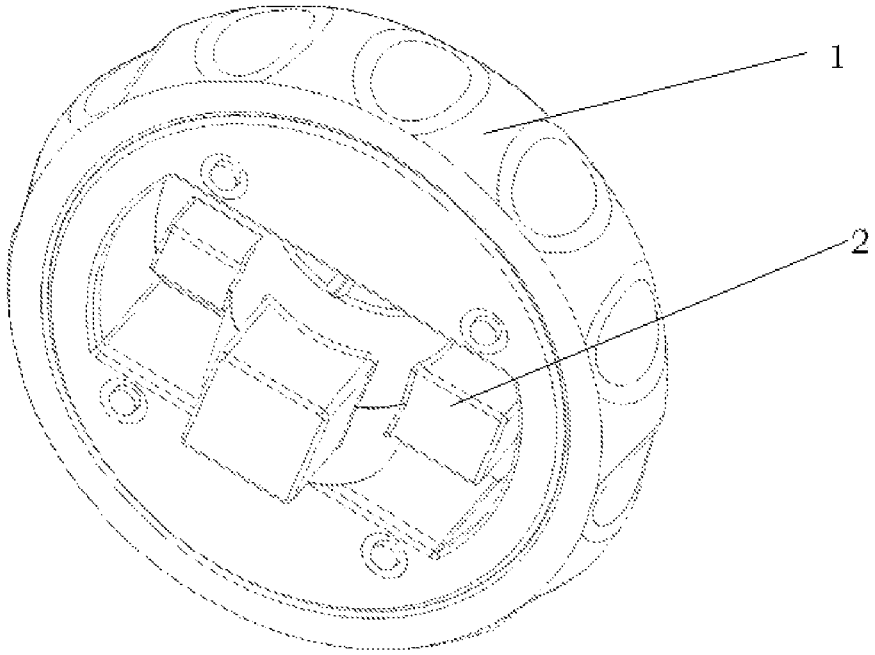
FIG. 1 is a perspective view of the present invention.
Figure 2:
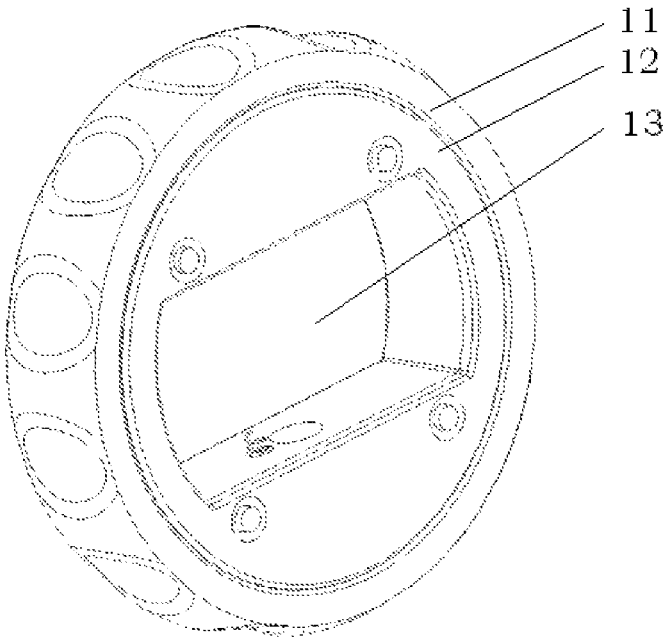
FIG. 2 is a schematic view showing the structure of the ratchet handle of the present invention.
Figure 3:
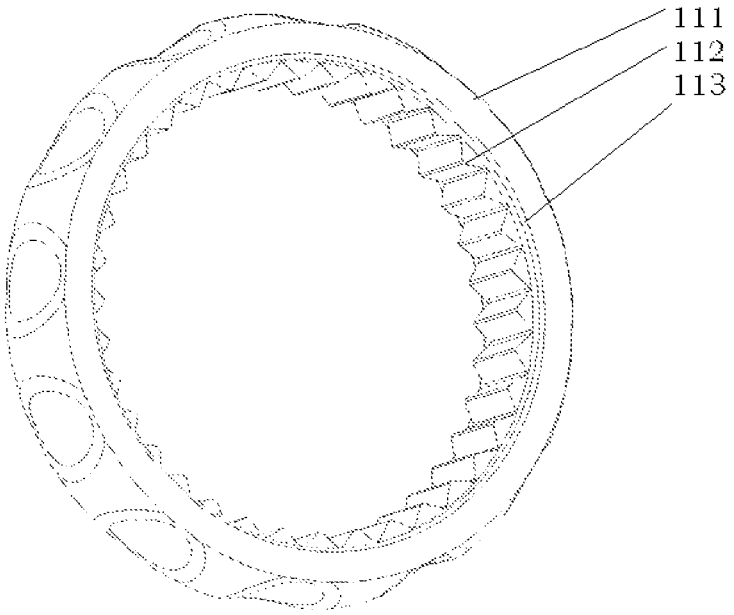
FIG. 3 is a schematic view showing the structure of the first outer casing of FIG. 2.
Figure 4:
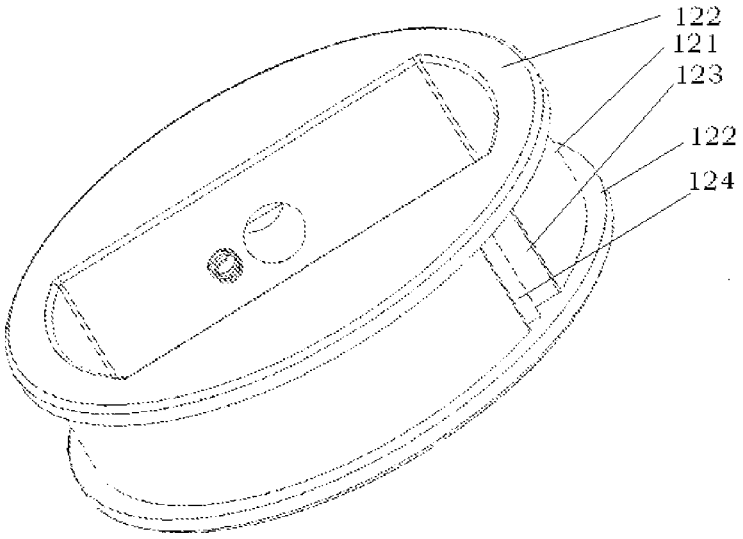
FIG. 4 is a schematic view showing the structure of the second outer casing of FIG. 2.
Figure 5:
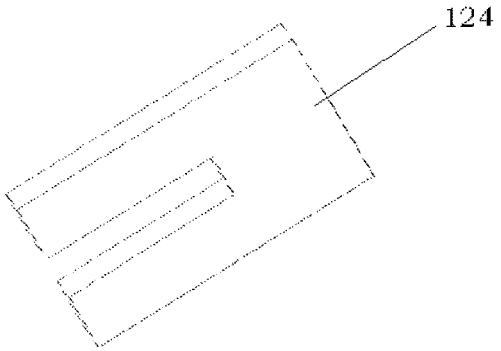
FIG. 5 is a schematic view showing the structure of the detent of FIG. 2.
Figure 6:
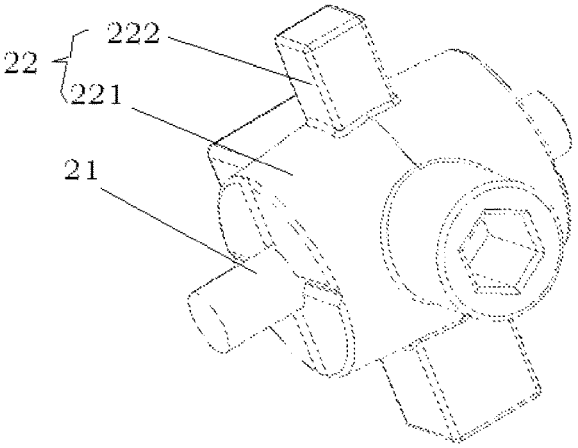
FIG. 6 is a schematic view showing the structure of the multi-tool assembly of the present invention.
Figure 7:
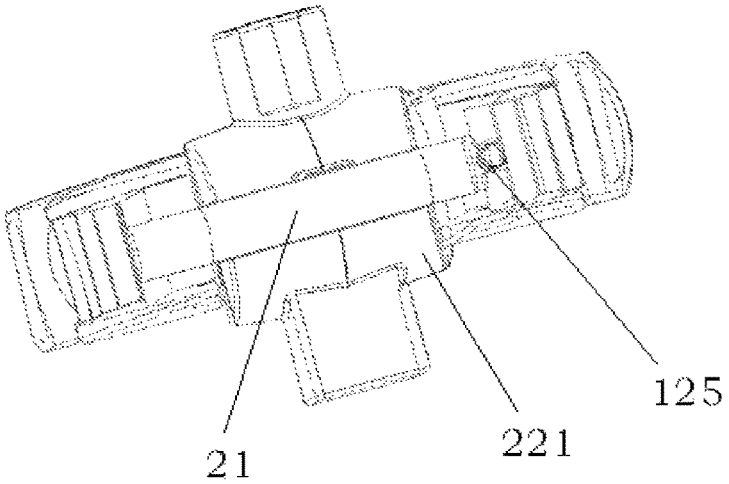
FIG. 7 is a sectional view of FIG. 1.

As shown in FIG. 1 through FIG. 6, a ratchet tool comprises a cylindrical ratchet handle 1 and a multi-tool assembly 2. The multi-tool assembly is mounted to the ratchet handle and rotatable relative to the ratchet handle. The multi-tool assembly comprises a plurality of tools, such as screwdriver bits or screwdriver bit sockets. When in use, a desired tool is turned out for use. Because of the same ratchet handle the present invention is time-saving and labor-saving. The outer casing of the ratchet handle is circular, which is convenient for the user to hold the ratchet tool.

The cylindrical ratchet handle of the present invention comprises a first outer casing 11 and a second outer casing 12. The second outer casing has an accommodation cavity 13 therein. The first outer casing 11 of the present invention comprises a first cylindrical outer casing main body 111. The inner wall of the first cylindrical outer casing main body is provided with ratchet teeth 112. The height of the ratchet teeth is lower than the height of the first outer casing to form an engaging portion 113. The second outer casing 12 comprises a second cylindrical outer casing main body 121. The second cylindrical outer casing main body is disposed inside the first outer casing. The outer circumference of the second cylindrical outer casing main body is against the ratchet teeth. The upper and lower ends of the second cylindrical outer casing main body are provided with a bottom casing 122, respectively. The bottom casing is detachably connected to the engaging portion of the first cylindrical outer casing main body. The bottom casing is configured to cover the exterior of the ratchet, preventing the second outer casing from sliding axially relative to the first outer casing.

The interior of the first outer casing 11 of the present invention is provided with the ratchet teeth 112. The second outer casing 12 is disposed inside the first outer casing. The second outer casing and the first outer casing engage with each other. The outer surface of the second outer casing is formed with an accommodation groove 123. The accommodation groove is provided with a detent 124 therein. A spring 125 is provided between the detent and the accommodation groove. The detent can be fully retracted into the accommodation groove by applying an external force.

In the present invention, the ratchet handle has an accommodation cavity therein. A multi-tool assembly is provided in the accommodation cavity and rotatable relative to the accommodation cavity.

The multi-tool assembly of the present invention comprises a fixing axle 21 and a multi-tool device 22. Two ends of the fixing axle 21 are connected to the second outer casing. The multi-tool device comprises a sleeve 221 and a plurality of tools 222. The outer side of the fixing axle 21 is provided with the sleeve 221. The outer side of the sleeve is provided with the plurality of tools 222.

When the present invention is used, the multi-tool assembly is rotatable relative to the cylindrical ratchet handle so that a desired tool can be to be turned out for use. The present invention has the ratchet, which is labor-saving and convenient.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A ratchet tool, comprising:

a ratchet handle having a first outer casing, a second outer casing and an accommodation cavity therein;

a multi-tool assembly provided in the accommodation cavity and rotatable relative to the accommodation cavity;

the multi-tool assembly including a fixing axle, two ends of the fixing axle being connected to the second outer casing, an outer side of the fixing axle being provided with a sleeve, and an outer side of the sleeve being provided with a plurality of tools;

an inner surface of the first outer casing having ratchet teeth, the second outer casing being disposed inside the first outer casing, and the second outer casing and the first outer casing engaging with each other;

an accommodation groove having a radially directed recess located in the circumferential direction of an outer surface of the second outer casing;

a rectangular detent having a top, a bottom, four sides, with a longitudinal slot extending through the rectangular detent from the top to the bottom, the rectangular detent located in the accommodation groove, wherein the detent can be fully retracted into the accommodation groove by applying an external force; and a spring located in the slot urging the detent and the accommodation groove apart.

2. The ratchet tool as claimed in claim 1, wherein the ratchet handle is a cylindrical ratchet handle.

* * * * *